US010295319B2

(12) United States Patent
Gibson et al.

(10) Patent No.: US 10,295,319 B2
(45) **Date of Patent: *May 21, 2019**

(54) AERODYNAMIC PROJECTILE

(71) Applicant: United Tactical Systems, LLC, Lake Forest, IL (US)

(72) Inventors: Gary E. Gibson, Riverwoods, IL (US); Michael A. Varacins, Burlington, WI (US); Jon Willson, Cecil, OH (US)

(73) Assignee: United Tactical Systems, LLC, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/693,615

(22) Filed: Sep. 1, 2017

(65) Prior Publication Data

US 2018/0023931 A1 Jan. 25, 2018

Related U.S. Application Data

(63) Continuation of application No. 15/006,866, filed on Jan. 26, 2016, now Pat. No. 9,766,049.

(60) Provisional application No. 62/108,270, filed on Jan. 27, 2015.

(51) Int. Cl.

| | |
|---|---|
| ***F42B 10/24*** | (2006.01) |
| ***F42B 10/26*** | (2006.01) |
| ***F42B 10/38*** | (2006.01) |
| ***F42B 10/44*** | (2006.01) |
| ***F42B 12/40*** | (2006.01) |

(52) U.S. Cl.

CPC ..... *F42B 10/38* (2013.01); *F42B 10/24* (2013.01); *F42B 10/26* (2013.01); *F42B 10/44* (2013.01); *F42B 12/40* (2013.01)

(58) Field of Classification Search

CPC .... F42B 8/14; F42B 8/16; F42B 10/00; F42B 10/02; F42B 10/22; F42B 10/24; F42B 10/26; F42B 10/32; F42B 10/34; F42B 10/38; F42B 10/42; F42B 10/44; F42B 12/36; F42B 12/46

USPC ..... 102/502, 503, 506, 529, 513

See application file for complete search history.

(56) References Cited

U.S. PATENT DOCUMENTS

| | | | | |
|---|---|---|---|---|
| 39,942 A | | 9/1863 | McMurtry | |
| 3,138,102 A | | 6/1964 | Meyer et al. | |
| 3,611,930 A | | 10/1971 | Kensinger | |
| 3,873,048 A | * | 3/1975 | Platou | F42B 10/44 102/501 |

(Continued)

OTHER PUBLICATIONS

Supplementary European Search Report for EP Application No. 16 74 4034, dated Jul. 24, 2018 (3 pages).

*Primary Examiner* — James S Bergin
(74) *Attorney, Agent, or Firm* — Barnes & Thornburg LLP

(57) ABSTRACT

A projectile has a front portion and a cylindrical portion. The cylindrical portion comprises a cylindrical sidewall having an outer surface and an inner surface. The projectile also has a plurality of depressions in the cylindrical sidewall. The depressions have an outlet adjacent the second end, an inlet toward the first end and a neck area between the inlet and the outlet. A width of the inlet is smaller than a width of the outlet. The depressions at the neck area have a curved sidewall, but a generally straight sidewall between the neck area and the outlet. The surface of the depression extends at a ramp angle from the outer surface of the sidewall at the inlet of the depression toward the inner surface of the sidewall at the outlet.

20 Claims, 3 Drawing Sheets

(56) References Cited

U.S. PATENT DOCUMENTS

| | | | | |
|---|---|---|---|---|
| 4,813,635 | A * | 3/1989 | Paterson | B62D 35/001 102/490 |
| 4,958,570 | A | 9/1990 | Harris | |
| 5,565,649 | A | 10/1996 | Tougeron | |
| 5,906,686 | A | 5/1999 | McNeil | |
| 6,223,658 | B1 | 5/2001 | Rosa | |
| 6,230,630 | B1 | 5/2001 | Gibson | |
| 6,615,739 | B2 | 9/2003 | Gibson | |
| 7,098,031 | B2 | 8/2006 | Choulika | |
| 7,228,802 | B2 | 6/2007 | Montefusco | |
| 7,526,998 | B2 | 5/2009 | Vasel | |
| 7,815,868 | B1 | 10/2010 | Jones | |
| 8,261,665 | B1 | 9/2012 | Walsh | |
| 8,875,634 | B2 | 11/2014 | Gibson | |
| 8,973,504 | B2 * | 3/2015 | Kim | F42B 10/44 102/490 |
| 9,021,957 | B1 | 5/2015 | Farina | |
| 9,766,049 | B2 | 9/2017 | Gibson | |
| 2005/0177098 | A1 | 8/2005 | Lin | |
| 2006/0011090 | A1 | 1/2006 | Vasel | |
| 2006/0110756 | A1 | 5/2006 | Tang | |
| 2006/0254453 | A1 | 11/2006 | Leal | |
| 2008/0264290 | A1 | 10/2008 | Salvel | |
| 2009/0101038 | A1 | 4/2009 | Kapeles | |
| 2009/0126602 | A1 | 5/2009 | Murphy | |
| 2009/0266262 | A1 | 10/2009 | Vasel | |
| 2010/0078844 | A1 | 4/2010 | Kapeles | |
| 2012/0017793 | A1 | 1/2012 | Huffman | |
| 2012/0199034 | A1 | 8/2012 | Gibson | |
| 2012/0199035 | A1 | 8/2012 | Frank | |
| 2012/0210903 | A1 | 8/2012 | Wilson | |
| 2013/0337949 | A1 | 12/2013 | Macy | |
| 2014/0318402 | A1 | 10/2014 | Carlson | |
| 2014/0352188 | A1 | 12/2014 | Widder | |
| 2014/0373745 | A1 | 12/2014 | Carlson | |
| 2015/0144018 | A1 | 5/2015 | Buys | |
| 2015/0369577 | A1 | 12/2015 | Tseng | |

* cited by examiner

AERODYNAMIC PROJECTILE

CROSS-REFERENCE TO RELATED APPLICATIONS

This application is a continuation of U.S. patent application Ser. No. 15/006,866, filed Jan. 26, 2016, now U.S. Pat. No. 9,766,049, issued on Sep. 19, 2017, and which claims priority to U.S. Provisional Patent Application No. 62/108,270, filed Jan. 27, 2015, both of which are expressly incorporated herein by reference and made a part hereof.

FEDERALLY SPONSORED RESEARCH OR DEVELOPMENT

Not Applicable.

TECHNICAL FIELD

The present invention relates generally to aerodynamic projectiles, and more particularly to aerodynamic projectiles having air inlets in the sidewall thereof, and which are suitable for non-lethal uses.

BACKGROUND OF THE INVENTION

Aerodynamic projectiles are well known in the art. While such projectiles according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a projectile having a front portion, a divider and a cylindrical portion. The front portion has a wall defining an interior cavity, which is closed by the divider. The cylindrical portion comprises a cylindrical sidewall having an outer surface and an inner surface. The projectile also has a plurality of depressions in the cylindrical sidewall.

The disclosed subject technology further relates to a projectile comprising: a generally hemispherical portion having an inner surface and an outer surface forming a generally hemispherical wall and a generally hemispherical interior volume; a divider engaging the generally hemispherical wall to close the hemispherical interior volume of the generally hemispherical portion; a cylindrical portion comprising a cylindrical sidewall adjacent the divider, the cylindrical sidewall having a first end adjacent the divider and a second end distal the divider, the cylindrical sidewall formed by an inner surface and an outer surface and having a wall thickness between the inner surface and the outer surface of the cylindrical sidewall; a plurality of depressions formed in the cylindrical sidewall, the depressions having an inlet distal the second end of the cylindrical sidewall and an outlet adjacent the second end of the cylindrical sidewall, wherein a width of the inlet is smaller than a width of the outlet, and a neck area between the inlet and the outlet, wherein an outer surface of the depression has a ramp surface extending at a ramp angle gradually from the outer surface of the cylindrical sidewall at the inlet to the depression toward the inner surface of the cylindrical sidewall at the outlet of the depression; and, a chamfer at the second end of the cylindrical portion, the chamfer generally extending from the bottom wall proximal the inner surface toward the outer surface of the cylindrical sidewall and toward the first end of the cylindrical sidewall.

The disclosed subject technology further relates to depressions at the neck area having a curved sidewall. In one embodiment, the depressions have a generally straight sidewall between the neck area and the outlet.

The disclosed subject technology further relates to depressions having a surface having a ramp angle that is between 1° and 15°. In another embodiment, the ramp angle is preferably about 3.5°.

The disclosed subject technology further relates to depressions provided at a transverse angle to a longitudinal axis of the projectile about the outer surface of the cylindrical sidewall. In one embodiment, the depressions are provided at an angle to the longitudinal axis of the projectile of between approximately 5° and approximately 15°. In another embodiment, the depressions are provided at an angle to the longitudinal axis of the projectile of approximately 9°.

The disclosed subject technology further relates to a projectile having a plurality of depressions that are symmetrically spaced around the outer surface of the cylindrical sidewall.

The disclosed subject technology further relates to a projectile having a plurality of geometrically shaped recesses in the cylindrical sidewall between the depressions. In one embodiment, the recesses are v-shaped.

The disclosed subject technology further relates to a projectile having depressions wherein a width of the inlet is approximately ⅓ of the width of the outlet.

The disclosed subject technology further relates to a projectile having an open rear cavity between the inner surface of the cylindrical sidewall.

The disclosed subject technology further relates to a projectile comprising: a front portion having a wall defining an interior cavity; a divider closing the interior cavity; a cylindrical portion comprising a cylindrical sidewall having an outer surface and an inner surface, the cylindrical sidewall having a first end adjacent the divider and a second end distal the divider; and, a plurality of depressions formed in the cylindrical sidewall, the depressions having an inlet distal the second end of the cylindrical sidewall and an outlet adjacent the second end of the cylindrical sidewall, wherein a width of the inlet is smaller than a width of the outlet, and a neck area between the inlet and the outlet, wherein the depressions at the neck area have a curved sidewall, and wherein the depressions have a generally straight sidewall between the neck area and the outlet.

The disclosed subject technology further relates to a projectile comprising: a front portion having a wall defining an interior cavity; a divider closing the interior cavity; a cylindrical portion adjacent the divider, the cylindrical portion comprising a cylindrical sidewall having an outer surface and an inner surface; and, a plurality of depressions formed in the cylindrical sidewall, the depressions having an inlet distal the second end of the cylindrical sidewall and an outlet adjacent the second end of the cylindrical sidewall, wherein a width of the inlet is smaller than a width of the outlet, and a neck area between the inlet and the outlet, wherein the depressions at the neck area have a curved sidewall, wherein the depressions have a generally straight sidewall between the neck area and the outlet, and wherein a surface of the depression has a ramp surface extending at a ramp angle gradually from the outer surface of the cylindrical sidewall at the inlet of the depression toward the inner surface of the cylindrical sidewall at the outlet of the depression.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
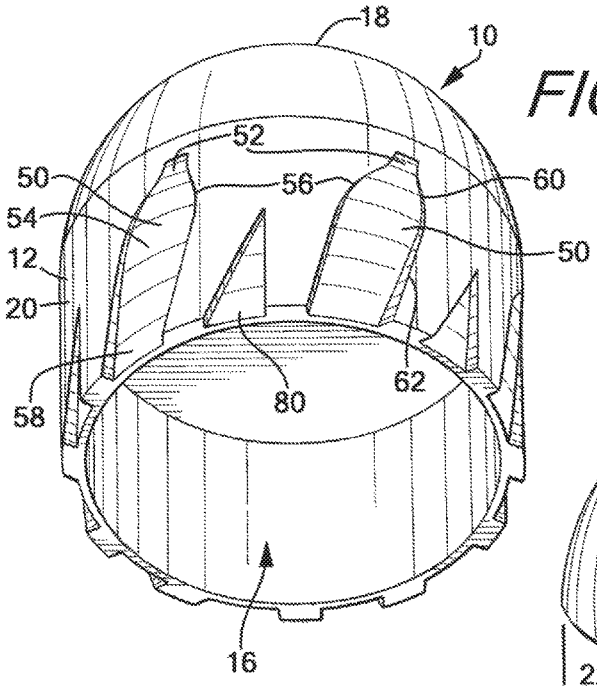
FIG. 1 is a bottom perspective view of one embodiment of an aerodynamic projectile having air inlets in the sidewall thereof.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, there is shown an aerodynamic projectile 10 for carrying a payload, and which is suitable for non-lethal uses, including recreational play. The aerodynamic projectile 10 generally comprises a shell 12 having a first front closed cavity 14 and a second open rear cavity 16. Preferably, the shell 12 of the aerodynamic projectile 10 fractures upon impact and may be used to mark a target. In one embodiment the projectile 10 may be fired from generally available compressed gas guns such as paint ball guns. Accordingly, in one embodiment the projectile 10 preferably has a maximum diameter of about 0.690 inches, the diameter of a typical paint ball.

In one embodiment the shell 12 comprises a generally hemispherical member 18 in a first portion of the projectile 10, a generally cylindrical sidewall member 20 in a second portion of the projectile 10, and a cross member or divider 22 between the hemispherical member 18 and the sidewall member 20. As shown in FIG. 1, in an alternate embodiment, the cross member 22 may be provide as part of the sidewall member 20, and further may be positioned below the joint between the hemispherical member 18 and the sidewall member 20. Such a configuration allows the front closed cavity 14 to have a larger volume. To accommodate a variety of materials that may be carried by the projectile 10, including but not limited to water, a water-based marking agent, a non-water based marking agent, and a powder, the shell 12 is preferably made from a plastic material which, preferably, does not present a projectile that develops a lethal force. In one embodiment, the hemispherical member 18 and the sidewall member 20 are manufactured from the same material. For instance, the shell 12 may be made according to U.S. Pat. Nos. 5,254,379 and 5,639,526. Such a shell 12 is resistant to moisture, of sufficient strength to permit manufacture of the desired projectile 10 and yet at the same time presents a readily frangible leading surface permitting ready marking of the individual or surface struck by the projectile, or for distribution of the payload, in a less lethal manner. Alternately, the hemispherical member 18 and the sidewall member 20 may be made of different materials. For example, the sidewall member 20 may be made of a material that is less frangible than the hemispherical member 18.

One suitable plastic for use in manufacturing the shell 12 is a polystyrene that is a linear polymer which yields a hemispherical portion that is substantially impervious to water and does not dissolve when contacted by rain or sweat or when placed in a warm humid environment. This impervious nature allows the shell to be used to contain a variety of products including water, smoke, tear gas, powders, gels, irritant substances and other items unsuitable for placement in known gelatin shells. The shell 12 may be formed from a linear polymer in several ways including injection molding and blow molding. However, the preferred method of forming the shell 12 of the invention is by injection molding of a linear thermoplastic polymer. In injection molding, the thermoplastic polymer is heated and then injected under high pressures into a mold. Using injection molding, the shell 12, and specifically, the generally hemispherical portion 18 of the shell 12 may have a thinner, more uniform wall structure.

Figure 4:
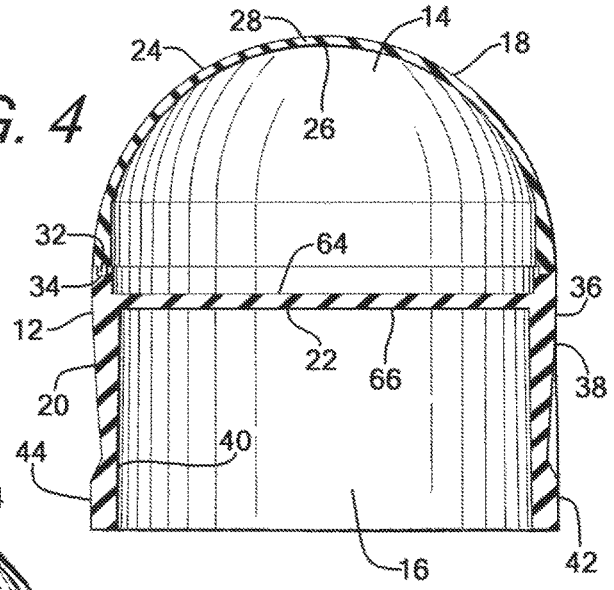
FIG. 4 is a cross-sectional side view about lines 4-4 of FIG. 3.

As shown in FIG. 4, the generally hemispherical member 18 has an outer surface 24 and an inner surface 26 which forms a generally hemispherical wall 28 and a generally hemispherical interior volume. In one embodiment, the thickness of the wall 28 is approximately 0.005" to about 0.040", and preferably approximately 0.015". Additionally, in a preferred embodiment, the outer diameter of the generally hemispherical member 18 is approximately 0.684". While not required, and not shown in the embodiments of the figures, the projectile 10 may have a fill hole or port opening that extends through the wall 28 of the hemispherical member 18, from the inner surface 26 through to the outer surface 24. In such an embodiment, the port opening may provide access to the front closed cavity 14 for filling of the cavity 14 with the payload, as is explained herein, after the hemispherical member 18 is connected to the sidewall member 20. If a fill hole is utilized, after introduction of the fill material or payload into the front closed cavity 14 through the fill hole, the fill hole may be sealed and then the sealed fill hole may be ground and polished smooth, presenting a generally smooth surface for the projectile 10 in the region of the fill hole.

Figure 2:
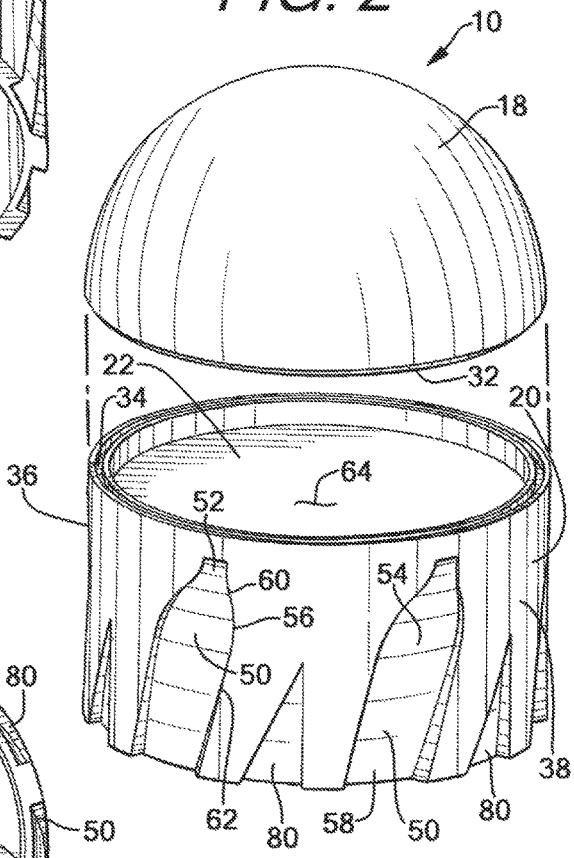
FIG. 2 is an exploded side perspective view of the aerodynamic projectile of FIG. 1.
Figure 5:
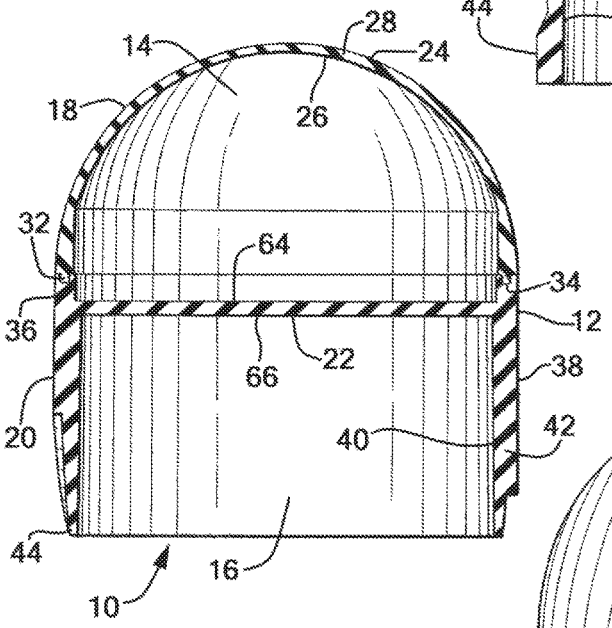
FIG. 5 is a cross-sectional side view about lines 5-5 of FIG. 3.

As shown in FIGS. 2, 4 and 5, in one embodiment the end of wall 28 of the generally hemispherical member 18 has a downwardly extending annular rib 32 that permits the joining of the hemispherical member 18 to the sidewall member 20. One embodiment of an annular rib 32 may be approximately 0.012" in height, and approximately 0.014" thick. The profile of the rim is created to match with the mating profile at a first end 36 of the sidewall member 20. Accordingly, in one embodiment a groove 34 is provided at the first end 36 of the sidewall member 20 to receive the annular rib 32 of the hemispherical member 18.

Referring to FIG. 1-5, the generally cylindrical sidewall member 20 has an outer surface 38 and an inner surface 40 defining a wall 42 of the sidewall member 20. The sidewall member 20 also has a first end 36 and a second end 44. In one embodiment, the length of the sidewall member 20 from the first end 36 to the second end 44 is approximately equal to the radius of the generally hemispherical member 18. In an alternate preferred embodiment the length of the sidewall member 20 may be larger than the radius of the generally hemispherical member 18 to provide a longer projectile 10. Further, in one embodiment the thickness of the wall 42 of the sidewall member 20 is approximately 0.015" to about 0.050". As explained below, because of various depressions and cut outs in the sidewall member 20, in one embodiment it can be said that the thickness of the sidewall member 20 varies at different locations on that member 20. As explained above, the sidewall member 20 has a groove 34 at the first end 36 of the sidewall member 20 to mate the sidewall member 20 with the annular rib 32 of the generally hemispherical member 18. Referring to FIG. 2, in a preferred embodiment the annular groove 34 extends inwardly from a top surface of the rim 46 of the sidewall member 20 to accept and mate with the annular rib 32 extending from the generally hemispherical member 18.

In one embodiment the sidewall member 20 is generally cylindrical in shape. Further, in one embodiment, the first end 36 or a location proximal the first end 36 of the sidewall member 20 is closed by the divider or cross member 22, and the second end 44 is open to provide an open rear cavity 16. Thus, in most preferred embodiments the sidewall member 20 can be said to be hollow because the second end 44 is open, providing access to the second open rear cavity 16, as explained herein. In another embodiment the diameter of the generally hemispherical member 18 is approximately equal to the diameter of the largest portion of the sidewall member 20.

In one embodiment the shell 12 also has a plurality of depressions 50 extending radially inwardly from the outer surface 38 of the wall 42 of the sidewall member 20. The depressions 50 preferably provide an internal recess for receiving air as the projectile 10 is propelled through the air and for imparting spin with less drag penalty on the projectile 10 in flight. The depressions 50 assist to promote a more stable and accurate flight of the projectile 10, especially at higher velocities. Further, projectiles 10 with the disclosed depressions 50 having a particular configuration, as identified herein, can be launched at faster speeds to increase the kinetic energy. And, the payload capacity of projectiles 10 with the disclosed depressions 50 is increased allowing for heavier projectiles where the ballistic coefficient is increased over prior art projectiles.

Figure 6:
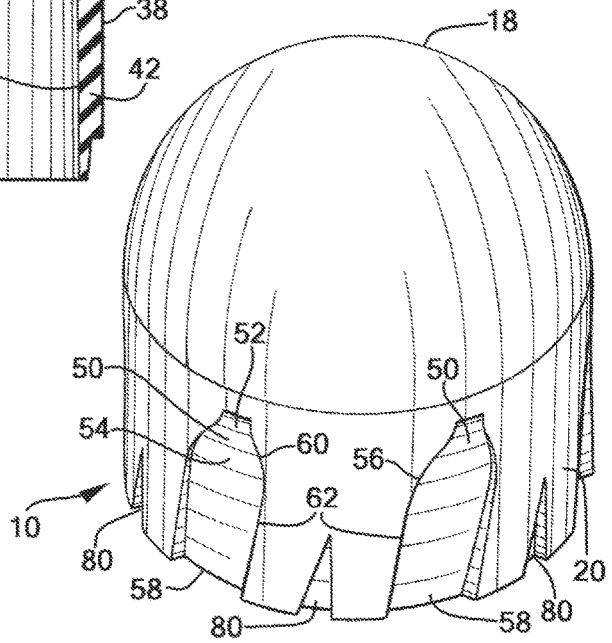
FIG. 6 is a top perspective view of the aerodynamic projectile of FIG. 1.

In one embodiment, as shown in FIGS. 1-6, the depressions 50 consist of an inlet 52 to a shallow ramp 54 having a shallow ramp angle with curved walls 56 recessed into the exposed outer surface 38 of the wall 42 of the sidewall member 20. Thus, the outer surface of the depressions 50 has a ramp surface extending at a ramp angle gradually from the outer surface of the cylindrical sidewall toward the inner surface of the cylindrical sidewall. In a preferred embodiment, the inlet 52 to each of the depressions 50 is provided closer to the first end 36 of the sidewall member 20 and distal the second end of the sidewall member 20. The ramp angle of the shallow ramp 54 is generally between 1° and 15°, but is preferably about 3.5°. The combination of the gentle ramp angle of the shallow ramp 54 and the curvature profile of the curved walls 56 assists in creating counter-rotating vortices which deflect the boundary layer away from the inlet 52 and draws in the faster moving air, while minimizing drag and flow separation. As shown in FIGS. 1, 2 and 6, the width of the inlet 52 of the depressions 50 is much smaller than the width of the outlet 58 of the depressions 50. Thus, the neck area 60 of the depressions 50 preferably has curved sidewalls 56 that transition from the narrow inlet 52 to the wider outlet 58. Additionally, the depressions 50 may have a straight sidewall portion 62 between the curved sidewall portion 56 and the outlet 58. As shown in the figures, the outlet 58 is provided at the second end 44 of the sidewall member 20 to allow the air that enters the inlet 52 of the depressions 50 to exit the depressions 50. Alternately, rather than having a ramped or sloped angle to the depression outer surface, the depression 50 outer surface may have a constant depth so that there exists a step rather than a ramp at the inlet 52.

In a preferred embodiment, the depressions 50 are provided at a transverse angle to the longitudinal axis of the projectile 10 about the outer surface 38 of the sidewall member 20. Having the depressions 50 provided at an angle to the longitudinal axis of the projectile 10 assists in promoting and/or imparting with a spinning motion to the projectile 10 as it flies through the air. In one embodiment the angle of the depressions 50 is approximately 9°, however, the angle may be between approximately 5° and approximately 15°. The spinning motion imparts added stability and accuracy to the projectile 10 when fired, thereby increasing the probability of hitting the intended target. In an alternate embodiment, the depressions 50 may have a slight curvature as they traverse the length of the hollow sidewall member 20. For example, the depressions 50 may curve around a small, i.e., approximately 0.07 revolutions per inch of depression length.

Figure 3:
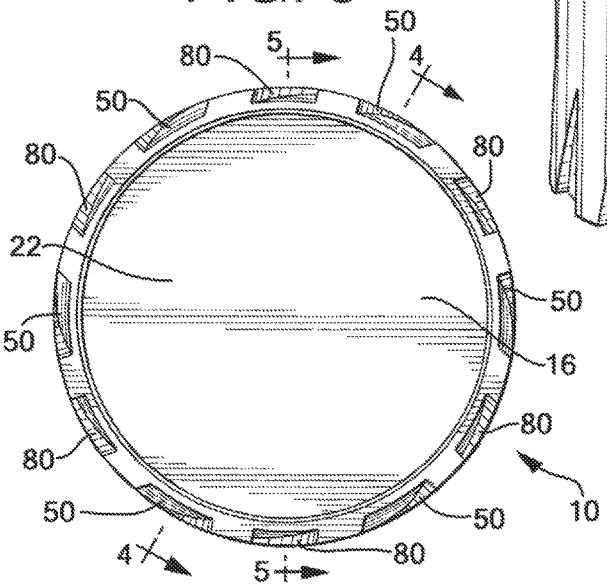
FIG. 3 is a bottom view of the aerodynamic projectile of FIG. 1.

Preferably, there are several angled depressions 50, such as six shown in the example of FIG. 3, symmetrically spaced around the outer surface 38 of the sidewall member 20. However, the projectile 10 may have a fewer number or a greater number of depressions 50 depending on the desired flight characteristics. In one embodiment the width of the depressions 50 at the inlet is approximately 0.048" and the width of the depressions 50 at the outlet 58 is approximately 0.136". However, the depressions 50 may be wider or narrower as required for the appropriate flight characteristics. In one embodiment, as shown in the figures, the depressions 50 get deeper as they extend from the first end 36 of the sidewall member 20 toward the second end 44 of the sidewall member 20.

Figure 7:
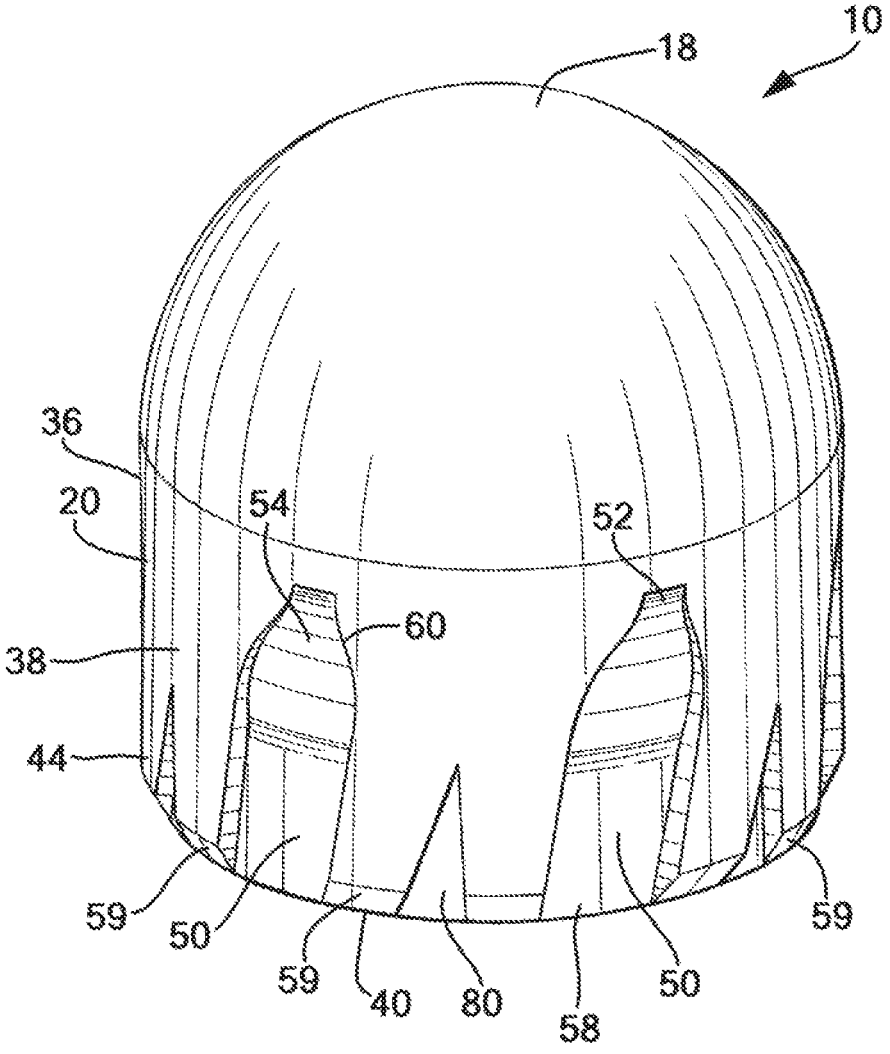
FIG. 7 is a side perspective view of another embodiment of the aerodynamic projectile.

As shown in FIG. 7, in one embodiment the projectile 10 has a chamfer 59 at the second end 44 of the cylindrical portion 20 of the sidewall member 20. In one embodiment, the chamfer 59 extends from the bottom wall proximal the inner surface 40 of the sidewall 20 toward the outer surface 38 of the sidewall 20. Additionally, the chamfer 59 is angled from the second end 44 of the cylindrical portion 20 toward the first end 36 of the cylindrical portion 20. The chamfer 59 may assist in flight stability, and it may also assist in loading the projectiles 10 in magazines of launchers.

As explained above, the shell 12 also comprises a divider or cross member 22. In a preferred embodiment, as shown in FIGS. 2, 4 and 5, the cross member 22 is an integral component of the sidewall member 20, however, it is understood that the cross member 22 may be an integral component of the hemispherical member 18, or it may be a separate component of the shell 12. As an integral component of the sidewall member 20 the cross member 22 is made of the same material as the sidewall member 20. Additionally, in a preferred embodiment the cross member 22 is recessed from the first end 36 of the sidewall member 20.

As shown in FIGS. 2, 4 and 5, in one embodiment the cross member 22 is provided a distance from the first end 36 of the sidewall member 20. In an alternate embodiment, not shown, the cross member 22 is provided at the first end 36 of the sidewall member 20, and the wall 42 of the sidewall member 20 extends distally away from the cross member 22. In the preferred embodiment, however, the cross member 22 has an first surface 64 that faces toward the front closed cavity 14 as shown in FIGS. 4 and 5, and a second surface 66 that faces inwardly, toward the inner surface 40 of the wall 42 of the sidewall member 20 (i.e., toward the rear open cavity 16. Thus, the combination of the second surface 66 of the cross member 22 and the inner surface 40 of the sidewall member 20 defines the second open rear cavity 16. As shown in FIGS. 1 and 3-5, in one embodiment the rear open cavity 16 is substantially cylindrical in shape, however, the rear open cavity 16 may have an alternate shape without departing from the scope of the present disclosure. In a preferred embodiment, the rear cavity 16 is entirely open as there is no rear wall or other structure closing the second end 44 of the sidewall member 20. And, there is preferably no additional structure radially interior of the sidewall member 20, thereby providing free access to the to the open rear cavity 16. Thus, in one embodiment the sidewall member 20 is hollow. Accordingly, with no rear wall the sidewall member 20 has much less weight than most prior projectiles, allowing the center of gravity of the projectile 10 to be located closer toward the front of the projectile 10, and resulting in greater in-flight accuracy of the projectile 10.

Once the hemispherical member 18 and the sidewall member 20 are prepared, they are fixedly joined together, preferably by ultrasonic welding although other suitable techniques, such as solvent welding, may be used employing conventional procedures. The use of such fixing techniques preferably precludes the two members from becoming separated prior to impact.

After the hemispherical member 18 and the sidewall member 20 are joined with the cross member 22 therebetween, the first front closed cavity 14 is complete. The first front closed cavity 14 and interior volume thereof is defined by the combination of the inner surface 26 of the generally hemispherical member 18 and the first surface 64 of the cross member 22. Accordingly, the cross member 22 operates as a divider between the front closed cavity 14 and the rear open cavity 16. In one embodiment the inner volume of the first closed cavity 14 is also generally semi-hemispherical in shape, however, it may also have an alternate geometric configuration. For example, a portion of the interior volume of the first closed cavity 14 adjacent the cross member 22, as shown in FIGS. 4 and 5, may also have a cylindrical shape, especially where the cross member 22 is recessed a distance below the first end 36 of the sidewall member 20.

Following the joining of the two component pieces (i.e., the hemispherical member 18 and the sidewall member 20), or prior to the joining of the two components, fill material may be added into the interior volume of the front closed cavity 14.

In one embodiment, the fill material is provided as a marking agent. In one preferred embodiment, such fill material is typically a fluid. The fluid is preferably a weighting agent in combination with a colorant to provide marking capability. The weighting agent is typically required to obtain the desired weight relationship of the projectile 10 to maintain the center of gravity of the projectile 10 in front of the center of pressure of the projectile 10 during flight of the projectile 10. Suitable coloring agents can be liquid or powder pigments and/or dyes. One such suitable coloring agent is a water soluble pigment and/or dye dispersed in water. Such a pigment and/or dye ultimately may be readily washed from the skin and clothing of a victim struck by the identified less lethal projectile 10. This permits the victim to remove the pigment and/or dye after apprehension. Another suitable coloring agent is a permanent pigment and/or dye.

Other suitable coloring agents include pigments and/or dyes which can be detected by infra red or ultraviolet light. Still other suitable coloring agents include pigments and/or dyes which glow in the dark to permit detection of identified individuals who have been marked during day light hours. In cases where the coloring agent is a chemical pigment and/or dye that is not compatible with the shell material, the coloring agent may be placed in miniature glass ampules which are subsequently added to the interior compartment. The use of glass ampules allows even a wider variety of chemicals to be used in combination with various shell materials. The glass ampules are preferably introduced into the closed cavity 14 of the hemispherical member 18 prior to the joining of the hemispherical member 18 and the sidewall member 20. Alternatively or additionally, the portions of the projectile can be further subdivided, e.g., by inserting one or more dividers 22 into the portions.

Alternatively or additionally, the front closed cavity 14 may be filled with an immobilizing component, such as an irritant or other noxious chemical. The irritant or noxious chemical can be in a liquid, powder, or a gaseous state. Suitable irritants include eye irritants, such as pepper powder or tear gas, and CF powder. Suitable noxious agents include such chemicals as malodorants which induce nausea and/or vomiting. As discussed above, any immobilizing component not compatible with the shell material may be placed in miniature glass ampules which are subsequently added to the interior compartment. Various marking and immobilizing agents are identified in U.S. Pat. No. 6,230,630, which is incorporated herein and made a part hereof.

If required, a weighting agent for the fill material may be introduced into the closed cavity 14 of the hemispherical member 18 either prior, after or during the introduction of the marking or immobilizing agent. Alternately, the weighting agent portion of the fill material may be composed of the marking agent, such as a dense marking agent.

Regardless of the specific marking or immobilizing agent used, in a preferred embodiment the fill material should have the desired weight relationship with the shell 12 of the projectile 10 to result in proper flight accuracy.

One such weighting or ballasting agent that is added to the marking agent to provide the appropriate weight for the fill material is barium sulfate, which may be added to the marking agent to result in the appropriate marking fill material. It is understood that other materials, such as bismuth and tungsten carbide, as well as others, may be utilized to attain the appropriate weight of the fill material. Adding weight to the projectile 10 improves the accuracy and aerodynamic properties of the projectile 10. The weighting agent is added to the fill material in an amount that achieves a center of gravity (Cg) of the projectile 10 positioned forward of the center of pressure (Cp) for the projectile 10 when fired. The center of gravity, which refers to the distribution of mass in the projectile, can be defined as the point at which the projectile would be perfectly balanced if it were suspended with no forces, other than gravity, acting on it. The center of pressure can be defined as the point at which the projectile 10 would be balanced if it were suspended with no forces, other than air pressure, acting on it, when viewed from the side when the projectile 10 is in flight. Preferably, the fill material is provided such that the center of gravity is positioned as far forward as possible without making the projectile 10 unstable. Such a location can be referred to as the ideal location for the center of gravity. In one embodiment the center of gravity is located within the closed cavity 14 and forward of the cross member 22.

To achieve the proper weight distribution such that the center of gravity is forward of the center of pressure of the projectile 10 during flight of the projectile 10, a dense fill material may be provided. The amount of weight of the fill material is calculated according to the size and weight of the projectile shell and the desired total weight of the projectile. Specifically, the amount of weighting agent added is that amount which, in combination with the filling material, has sufficient volume to fill the interior cavity 14 and sufficient weight to produce the desired total weight of the projectile, taking into consideration the weight of the projectile shell, such that the center of gravity is forward of the center of pressure during flight of the projectile 10. Most importantly, the distribution of weight in the projectile is necessary to have the center of gravity of the projectile be maintained in front of the center of pressure of the projectile during flight of the projectile.

In order to achieve the center of gravity in front of the center of pressure while still maintaining the proper overall weight required for the application, it is optimal to take as much weight out of the shell 12 as possible. The open back to the open cavity 16 assists in providing such decreased weight for the shell 12. Another means is to have additional material removed from the sidewall member 20. For example, as shown in FIGS. 1-6, geometrically shaped recesses 80 are provided in the sidewall 20 between the depressions 50. The recesses 80 may have a consistent depth, and may also have a portion that joins the second end 44 of the sidewall member 20 as an end opening to the recesses 80. In one embodiment, the recesses 80 have a triangular shape with an approximate 25° angle, however, other shapes are possible. Additionally, in one embodiment the recesses 80 are provided at an angle to the longitudinal axis of the projectile 10, similar to the depressions 50. The angle may be the same or it may be different. It has been found that the triangular or V-shaped recess 80 adds aerodynamic stability such that the projectile 10 is more accurate when fired. The V-shaped recess 80 may also assist in producing more spin for the projectile 10, especially when the recesses 80 are provided at an angle to the longitudinal axis of the projectile 10.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention.

What is claimed is:

1. A projectile comprising:

a generally hemispherical front portion having an outer surface forming a generally hemispherical wall;

a cylindrical portion comprising a cylindrical sidewall, the cylindrical sidewall having a first end adjacent the generally hemispherical front portion and a second end distal the generally hemispherical front portion, the cylindrical sidewall formed by an inner surface and an outer surface and having a wall thickness between the inner surface and the outer surface of the cylindrical sidewall; and, a plurality of depressions formed in the cylindrical sidewall, each of the plurality of depressions having an inlet distal the second end of the cylindrical sidewall and an outlet adjacent the second end of the cylindrical sidewall, wherein a width of the inlet is smaller than a width of the outlet, and a neck area between the inlet and the outlet, wherein each of the plurality of depressions has a ramp surface extending at a ramp angle gradually from the outer surface of the cylindrical sidewall at the inlet to each of the plurality of depressions toward the inner surface of the cylindrical sidewall at the outlet of each of the plurality of depressions such that a depth of each of the plurality of depressions at the outlet is greater than a depth of each of the plurality of depressions at the inlet.

2. The projectile of claim 1, wherein the generally hemispherical front portion has an interior cavity defined by an inner surface of the generally hemispherical front portion.

3. The projectile of claim 2, further comprising a divider between the generally hemispherical front portion and the cylindrical portion, the divider closing the interior cavity of the generally hemispherical front portion.

4. The projectile of claim 1, wherein the plurality of depressions, at the neck area, have a curved sidewall.

5. The projectile of claim 1, wherein the plurality of depressions have a generally straight sidewall between the neck area and the outlet.

6. The projectile of claim 1, wherein the ramp angle is between 1° and 15°.

7. The projectile of claim 1, wherein the plurality of depressions are provided at an angle to the longitudinal axis of the projectile of between approximately 5° and approximately 15°.

8. The projectile of claim 1, wherein the plurality of depressions are symmetrically spaced around the outer surface of the cylindrical sidewall.

9. The projectile of claim 1, further comprising a plurality of geometrically shaped recesses in the cylindrical sidewall between the plurality of depressions.

10. The projectile of claim 1, wherein the width of the inlet is approximately ⅓ of the width of the outlet.

11. The projectile of claim 1, further comprising an open rear cavity in the cylindrical portion.

12. A projectile comprising:

a front portion;

a cylindrical portion comprising a cylindrical sidewall having an outer surface, the cylindrical sidewall having a first end adjacent the front portion and a second end distal the front portion; and, a plurality of depressions formed in the cylindrical sidewall, each of the plurality of depressions having an inlet distal the second end of the cylindrical sidewall and an outlet adjacent the second end of the cylindrical sidewall, wherein the outlet of each of the plurality of depressions is open through the second end of the cylindrical portion of the projectile, wherein a width of the inlet is smaller than a width of the outlet, and a neck area between the inlet and the outlet, wherein each of the plurality of depressions at the neck area have a curved sidewall, and wherein each of the plurality of depressions have generally straight and parallel opposing sidewalls between the neck area and the outlet, and wherein the sidewalls are generally perpendicular to an outer surface of the plurality of depressions.

13. The projectile of claim 12, wherein the front portion has an interior cavity.

14. The projectile of claim 13, further comprising a divider closing the interior cavity in the front portion.

15. The projectile of claim 12, wherein the outer surface of the plurality of depressions has a ramp surface extending at a ramp angle gradually from the outer surface of the cylindrical sidewall at the inlet of the plurality of depressions toward the inner surface of the cylindrical sidewall at the outlet of the plurality of depressions such that a depth of the plurality of depressions at the outlet is greater than a depth of the plurality of depressions at the inlet.

16. The projectile of claim 12, wherein the plurality of depressions are provided at a transverse angle to the longitudinal axis of the projectile.

17. The projectile of claim 12, wherein the plurality of depressions are symmetrically spaced around the outer surface of the cylindrical sidewall.

18. A projectile comprising:

a front portion having a wall defining an interior cavity;

a cylindrical portion adjacent the front portion, the cylindrical portion comprising a cylindrical sidewall having an outer surface and an inner surface; and, a plurality of depressions formed in the cylindrical sidewall, the plurality of depressions having an inlet distal a second end of the cylindrical sidewall and an outlet adjacent the second end of the cylindrical sidewall, wherein a width of the inlet is smaller than a width of the outlet, and a neck area between the inlet and the outlet, wherein the plurality of depressions at the neck area have a curved sidewall, wherein the plurality of depressions have a generally straight sidewall between the neck area and the outlet, and wherein a surface of the plurality of depressions has a generally flat ramp surface extending at a ramp angle gradually from the outer surface of the cylindrical sidewall at the inlet of the plurality of depressions toward the inner surface of the cylindrical sidewall at the outlet of the plurality of depressions such that the outlet of the plurality of depressions is open through the second end of the cylindrical portion of the projectile.

19. The projectile of claim 18, further comprising a chamfer at the second end of the cylindrical portion, the chamfer generally extending from a bottom wall at the second end proximal the inner surface of the cylindrical sidewall toward the outer surface of the cylindrical sidewall and toward a first end of the cylindrical sidewall.

20. The projectile of claim 18, wherein the ramp surface extends gradually from the outer surface of the cylindrical sidewall at the inlet of the plurality of depressions toward the inner surface of the cylindrical sidewall at the outlet of the plurality of depressions such that a depth of the plurality of depressions at the outlet is greater than a depth of the plurality of depressions at the inlet.

* * * * *